United States Patent [19]

Crone

[11] Patent Number: 4,896,744

[45] Date of Patent: Jan. 30, 1990

[54] BOAT LADDER AND CARRIER ASSEMBLY

[76] Inventor: John R. Crone, P.O. Box 244, Heber Springs, Ark. 72543

[21] Appl. No.: 256,311

[22] Filed: Oct. 11, 1988

[51] Int. Cl.[4] ..... B63B 27/00

[52] U.S. Cl. ..... 182/88; 182/91; 114/362

[58] Field of Search ..... 182/88, 90, 91; 280/166; 114/362

[56] References Cited

U.S. PATENT DOCUMENTS

| | | | |
|---|---|---|---|
| 2,279,329 | 4/1942 | King | 182/88 |
| 4,735,285 | 4/1988 | Ritten | 182/91 |

*Primary Examiner*—Reinaldo P. Machado
*Attorney, Agent, or Firm*—Richard C. Litman

[57] ABSTRACT

A ladder and carrier assembly for attachment beneath the deck of a boat, such as a pontoon boat or party boat, includes a carrier suspended horizontally below the boat deck and provided with a rearmost transverse end element. A ladder support assembly mounted adjacent the forwardmost end of the carrier is provided with a pair of transverse rods disposed in vertical planes laterally offset from one another and which define a ladder clearance therebetween. A ladder having two longitudinal siderails includes a plurality of transverse steps and is disposed within the clearance of the support assembly. Restriction in displacement of the ladder from a substantially horizontal stowed position, to that of an extended inclined position, is controlled by a pair of stop members depending from the inner faces of the ladder siderails, adjacent their rear ends, and which alternately abut the carrier end element and one of the support assembly rods.

3 Claims, 2 Drawing Sheets

BOAT LADDER AND CARRIER ASSEMBLY

BACKGROUND OF THE INVENTION

This invention relates in general to boat ladders used for entry and exit from water and in particular to boat ladders for use on pontoon boats, party barges, etc.

This latter is an improvement in presently available boat ladders in that it is stored beneath the deck of the boat so that it isn't a safety hazard and it can be placed in use by someone that is in the water.

Figure 1:
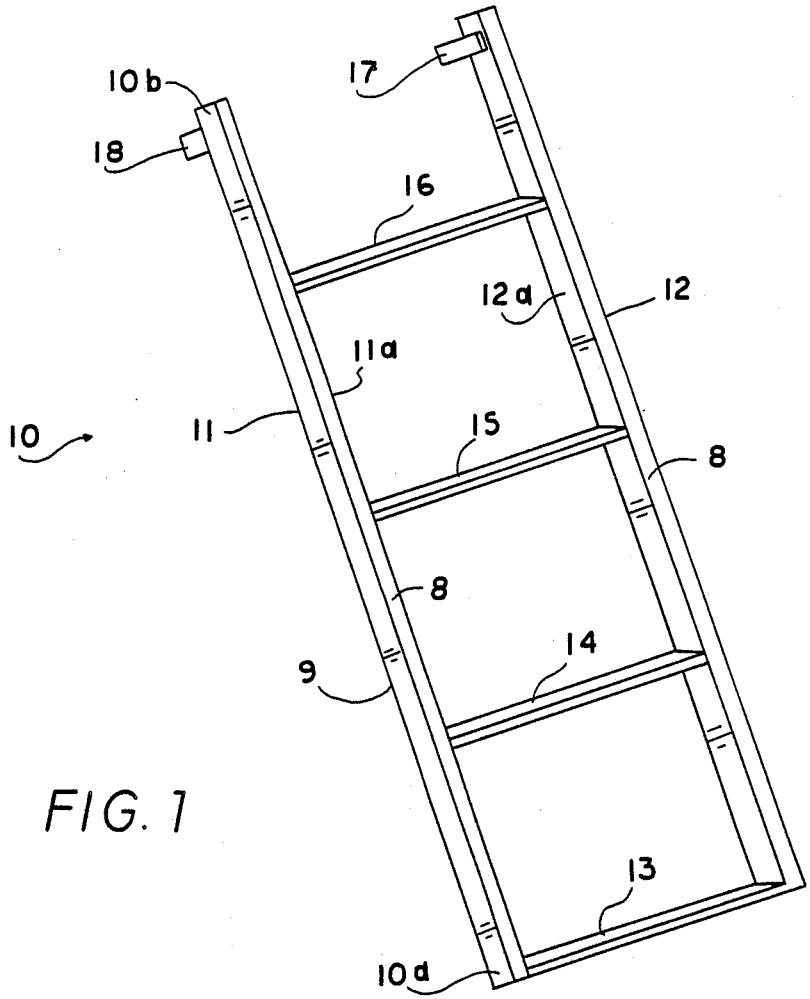
FIG. 1 is a front perspective view of the ladder.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

In FIG. 1 there is illustrated a ladder 10 consisting of siderails 11 and 12, each having a front end 10*a* and rear end 10*b*. A plurality of transversely disposed steps 13, 14, 15 and 16 are joined to the two siderails with the step 13 comprising a lower step affixed to the front ends 10*a* of the siderails 11–12 and the step 16 forming an upper step located well spaced inwardly from the siderail rear ends 10*b*. Depending from the inner faces 11*a*–12*a* of the two siderails 11–12, adjacent the rear ends 10*b*, are a pair of stop members 17 and 18.

Figure 2:
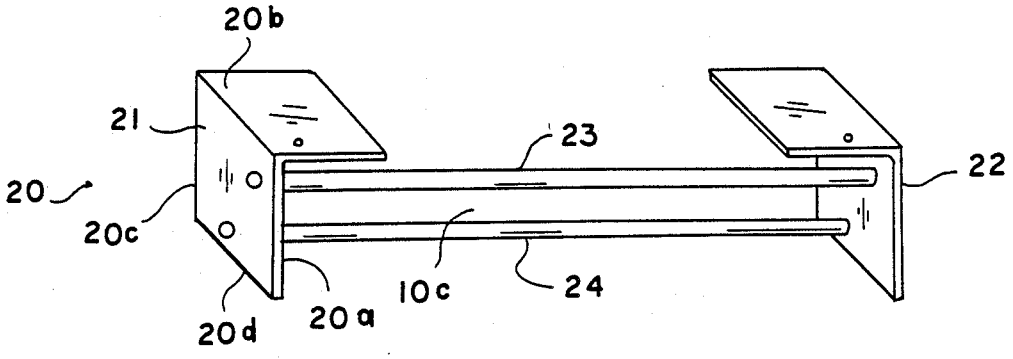
FIG. 2 is a front perspective view of the ladder support member.

In FIG. 2 there is illustrated a ladder support assembly 20 consisting of right hanger 21, left hanger 22, joined by transversely extending rods 23 and 24 defining a horizontally disposed ladder space or clearance 10*c*. As will be seen from this view, the top rod 23 is attached to the two hangers 21–22 adjacent the front 20*a* and top 20*b* of the hangers while the bottom rod 24 is connected to the hangers adjacent the rear 20*c* and bottom 20*d* thereof, such that the two rods 23–24 are vertically staggered or offset when viewed from the side of either hanger 21–22, for reasons which will become apparent hereinafter.

Figure 3:
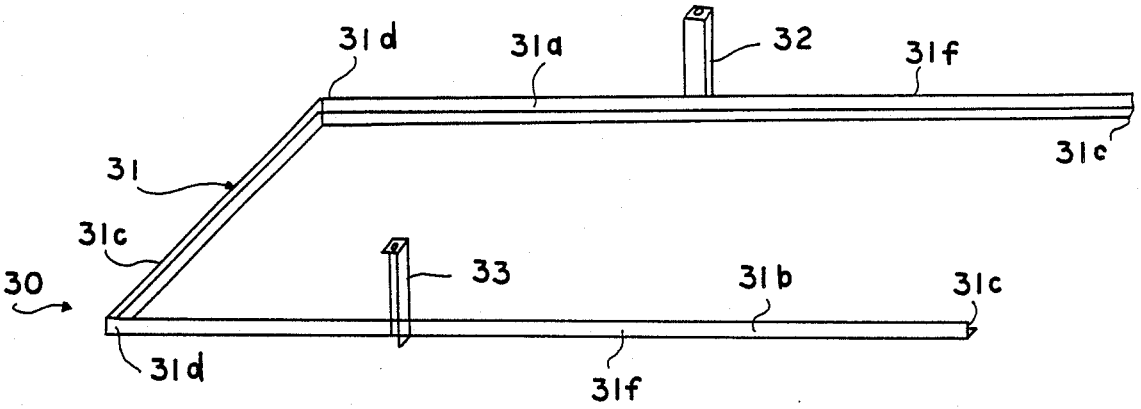
FIG. 3 is a view top perspective view of the ladder carrier.

In FIG. 3 there is illustrated a carrier 30 consisting of frame 31 including a pair of longitudinal side elements 31*a*–31*b* having free, forward ends 31*c*–31*c* and opposite, rear ends 31*d* respectively joined by a transverse end element 31*e*. Projecting upwardly from the outer face 31*f* of the side elements 31*a*–31*b* are right member or bracket 33 and left member or bracket 32.

Figure 4:
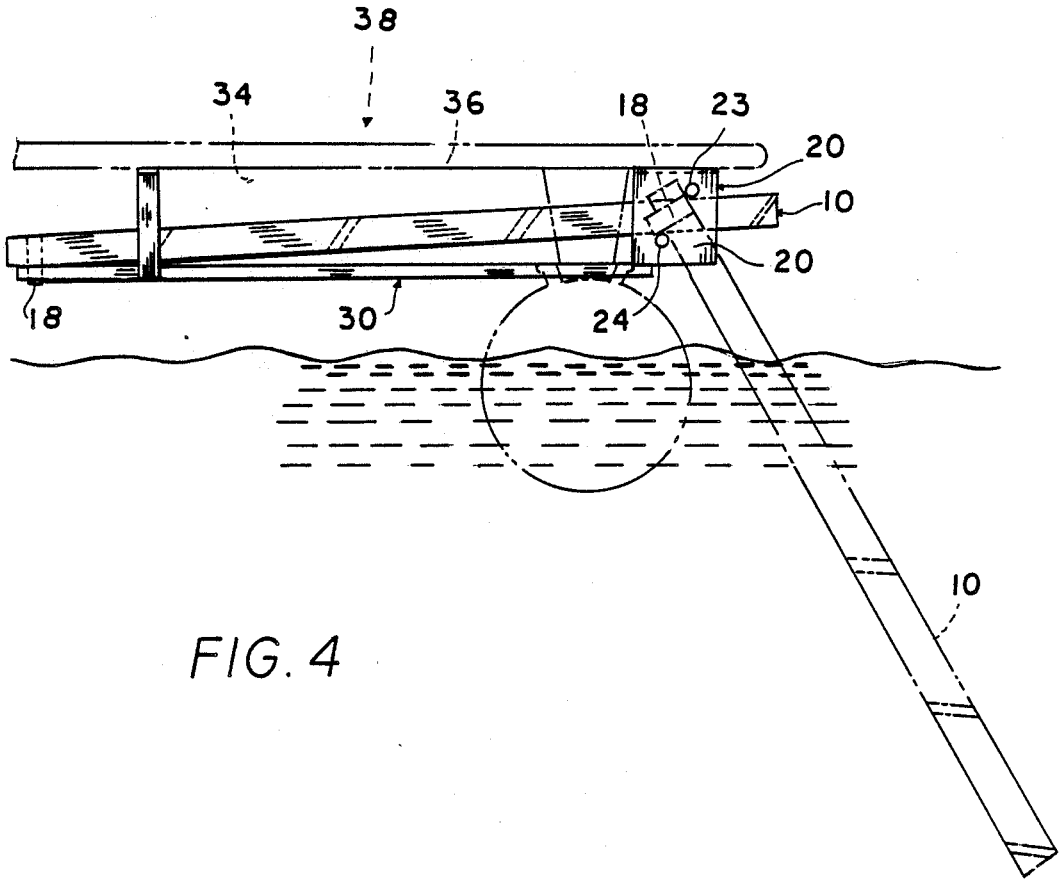
FIG. 4 is a side elevation illustrating the assembled components of FIGS. 1–3 and depicting alternate positions of the ladder in full and broken lines.

Referring now to FIG. 4 of the drawings, the assembly of the above described components will now be related. The carrier 30 and support assembly 20 will be understood to remain as stationery components beneath the undersurface 34 of the deck 36 of a boat 38 such as a party barge, pontoon boat or the like, with this assembly being retained through any suitable attachment of the carrier mountings 32–33 and support member tops 20*b*—20*b*. The ladder 10, when in a normal non-use or stowed condition, is disposed as shown in the full-line position in FIG. 4 wherein it will be observed that the ladder stops 17–18 abut the carrier end element 31*e* while the forward portion of the ladder 10 extends through the support member clearance 10*c* formed between its top and bottom rods 23,24 respectively, with the siderail top and bottom surfaces 8 and 9 juxtaposed the two rods.

To use the ladder 10, it is extended from the substantially horizontal full-line position of FIG. 4 to the downwardly directed broken-line position whereupon it will be appreciated that the ladder rear end portions 10*b* pivot within the support member clearance 10*c*. The ladder is retained in this extended, use position as the siderails 11–12 engage the top rod 23 while the ladder stops 17–18 engage the bottom rod 24. After using the ladder, it is returned to its stowed condition merely by pivoting it upwardly while sliding it along the bottom support member rod 24 until the ladder stops abut the carrier end element 31*e*.

What is claimed is:

1. A ladder assembly for attachment beneath the deck of a boat comprising;

a carrier including two side elements having opposite forward and rear ends, an end element fixedly spanning said side element rear ends, means mounting said carrier beneath the deck of a boat, a support assembly mounted beneath the boat deck adjacent said carrier forward ends and including transversely disposed top and bottom rods having opposite ends and spaced from one another to provide a ladder receiving clearance therebetween, said top rod disposed in a vertical plane substantially laterally offset forwardly from the vertical plane of said bottom rod, a ladder having two elongated siderails joined by a plurality of steps spaced from one another along the extent of said ladder siderails, said siderails each including a planar top and bottom surface joined to an inner face and provided with opposite front and rear ends, stop means on said ladder siderails adjacent said rear ends, said stop means including a stop member on each said siderail inner face and projecting downwardly beyond said bottom surface, said ladder siderails disposed within said clearance between said support member top and bottom rods, and said ladder shiftable in a substantially horizontal direction from a stowed position atop said carrier with said stop members abutting said carrier end element, to an extended use position inclined downwardly from said support assembly with said ladder stop members abutting said support member bottom rod and said ladder siderail rear end top surfaces abutting said support member top rod.

2. A ladder assembly according to claim 1 wherein, said carrier mounting means includes a bracket projecting upwardly from each said side element.

3. A ladder assembly according to claim 1 wherein, said support assembly includes left and right hangers respectively supporting said opposite ends of said top and bottom rods, said hangers each having a top, front, bottom and rear, and said top rod ends disposed adjacent said top and front of said hangers with said bottom rod ends disposed adjacent said bottom and rear of said hangers.

* * * * *